United States Patent [19]

Michelson

[11] 4,311,184

[45] Jan. 19, 1982

[54] ASSEMBLY FOR FORMING HOLLOW FOUNDRY PRODUCTS

[76] Inventor: Anatol Michelson, 3235 Pine Valley Dr., Sarasota, Fla. 33579

[21] Appl. No.: 187,716

[22] Filed: Sep. 16, 1980

Related U.S. Application Data

[62] Division of Ser. No. 44,774, Jun. 1, 1979, abandoned.

[51] Int. Cl.[3] ..... B22C 9/12

[52] U.S. Cl. ..... 164/165; 164/16; 164/213

[58] Field of Search ..... 164/12, 16, 165, 183, 164/213, 224, 361

[56] References Cited

U.S. PATENT DOCUMENTS

| | | | |
|---|---|---|---|
| 3,482,619 | 12/1969 | Hulslander | 164/183 |
| 3,528,481 | 9/1970 | Lund | 164/183 |
| 3,587,709 | 6/1971 | Miller et al. | 164/16 X |
| 3,682,230 | 8/1972 | Blower et al. | 164/165 |
| 4,089,363 | 5/1978 | Dunlop | 164/16 |
| 4,232,726 | 11/1980 | Michelson | 164/165 X |

FOREIGN PATENT DOCUMENTS

| | | | |
|---|---|---|---|
| 2145522 | 3/1972 | Fed. Rep. of Germany | 164/183 |
| 48-14290 | 5/1973 | Japan | 164/16 |

*Primary Examiner*—Robert D. Baldwin

[57] ABSTRACT

An assembly and method of operation of forming hollow foundry products such as shell molds from a granular material utilizing a substantially automated structure including a mold box assembly having at least two box sections pivotally mounted and supported on a frame wherein each box section has a gas permeable pattern with a preconfigured working surface mounted therein. Each box section is oriented to pivot about a vertically oriented separating plane into and out of sealing engagement with one another so as to expose the interior of the mold box assembly to a catalyst gas, under pressure and in direct communication through the pattern sections with the binder coated sand or granular material in a manner which will cause formation of a core or mold of a predetermined thickness which, during its formation, is disposed directly contiguous the working surface of the pattern section. Automatic removal of the formed product is accomplished upon separation of the box sections away from the vertically oriented separating plane substantially concurrently to removal, and transfer of the unused granular material for reuse during subsequent cycles of operation of the subject structure.

22 Claims, 8 Drawing Figures

ASSEMBLY FOR FORMING HOLLOW FOUNDRY PRODUCTS

This is a division of application Ser. No. 44,774 filed on June 1, 1979, now abandoned.

BACKGROUND OF THE INVENTION

1. Field of the Invention

This invention relates to a structural assembly of the type used for the production of foundry molds from a granular material in a substantially automated fashion wherein the process of charging the mold box assembly and associated pattern sections, hardening the granular charge into a predetermined configuration and dimension, removal of the formed foundry product and unused granular portion and entire recycling of the set forth operation is accomplished.

2. Description of the Prior Art

The original process for producing shell cores and molds was developed by Dr. Johannes Croning in Germany during World War II. Dr Croning's process was directed to the use of thermal setting resins and producing a fluidized hardenable synthetic resin mixture. To date the Croning process is used but has serious drawbacks due to the fact that the resin utilized results in a hardening of the binder under the action of heat in the range of 400° F. to 480° F. To create such heat large amounts of natural gas are used in foundries employing the Croning process. In addition the subject Croning process necessitates the construction of core boxes of high heat resistence. Such core box structures are obviously subject to relatively short life cycles.

Other disadvantages associated with the Croning process include undesirable working conditions as well as significantly long curing times. These long curing times result in low productivity. Example of such curing times are three minutes for a ten pound core.

In order to overcome the obvious disadvantages associated with the Croning process other foundry processes have been developed for producing cores and/or molds. Such process is known as the "cold box" process first generally demonstrated in 1968. Such process involved the coating of a sand or granular material with a binder and then curing the binder coated sand by passing a catalyst gas through the sand mixture once the sand is disposed into its predetermined configuration due to formation with a pattern structure.

One major disadvantage associated with the cold box process involves the relatively greater weight of the produced core or mold caused by the entire volume defined within the pattern of the mold box being filled with sand and hardened by exposure to the catalyst gas. Such weight was generally in the range of three to four times heavier than comparably sized shell cores or molds. This obviously resulted in waste of material, increased production costs and product handling problems.

However, more recently a method of manufacturing shell molds utilizing the "cold box" process was developed by Dunlop as disclosed in U.S. Pat. No. 4,089,363. According to Dunlop a shell type mold can be formed by creating a distinct pressure differential within a mold box or gasing chamber through introduction of catalyst gas after exposure of binder coated sand to a working surface of a vented pattern. While the Dunlop process clearly eliminates the problems previously associated with "cold box" processes due to excess weight, Dunlop still uses manually oriented procedures and does not show or describe a technique readily adaptable to mass production of molds. In Dunlop it would appear that the working surface of the resulting mold does not exactly correspond to the precisely configured working surface of the pattern and therefore is questionable practical application.

SUMMARY OF THE INVENTION

The subject invention is directed towards a structural assembly capable of producing, on a substantially mass production and/or automated basis, foundry shell molds.

More specifically structural features of the subject invention include a mold box assembly having at least two box section pivotally supported on a supporting frame and positionable between an open and closed, gas sealed relation. When in its closed position the mold box assembly defines a gasing chamber having pattern means formed therein. The pattern means comprises a pattern section formed in each mold box section and further being disposed therein in spaced relation to the base of the mold box section so as to create a void therebetween. A supply of catalyst gas is disposed in fluid communicating relation with the interior of each box section wherein the flow of such gas is regulated by proper valving so as to charge each section and the interior of the mold box assembly itself with catalyst gas under a predetermined pressure for direct fluid communication with a mass of precharged sand or granular particles. The sand mass is of course binder coated so as to form a hardened shell mold. When the binder is exposed to the catalyst gas, polymerisation of the binder is affected causing the coated sand to bind together.

As is known each pattern section, mounted within each box section is disposed into a predetermined configuration corresponding to the configuration of the mold product being produced. Each such pattern section defines a working surface where, in the structural features of the present invention such working surface at each pattern section are disposed in exposed relation to one another and to interior portion defined by the pattern means itself. The sand charge is disposed therein such that the working surface is in direct communication with a contiguous layer of granular material.

After charging of the interior portion with the binder coated sand or granular material catalyst gas is forced into the mold box assembly and passes, through the previous material pattern section into direct communication with predetermined "layers" of the charged sand mass. Based on the fact that the mold box assembly is closed and sealed and that the catalyst gas is exerted under a predetermined pressure, a specific thickness of the charged sand mass immediately contiguous or adjacent the working surface of each pattern section is exposed in direct communication with the catalyst gas. Such exposure results in hardening of the exposed sand particle due to the action of the binder in the presence of the catalyst gas. This forms a shell mold of predetermined thickness. After formation the catalyst gas is evacuated from the mold box assembly through proper valving and the mold box assembly is disposed to its open position.

Such open position is defined by each box section and the associated mounted pattern therein being pivoted outward in an arcuate vertical path from an imaginary vertically oriented separating plane defined by the peripheral sealed engagement of the two box sections when disposed in its closed gas tight position.

The process of operation of the structural features of the present invention include the automatic dispersion due to gravity of the unused portion of the charged sand or granular mass as both box sections move away from one another into their open position. Such unused sand falls into a conveyor assembly defining a transfer means wherein the conveyor includes a hopper disposed for collection of the unused portion of the sand and further includes a conveyor portion of the assembly for transfer of the unused sand back to the upper hopper above blow head or sand supply means.

Upon reaching a predetermined separated position of the box sections, an ejection means is activated by engagement with predetermined interruptively disposed portions of the frame so as to force the formed shell mold product from each of the pattern sections. These products are transferred to removal conveyors which are in turn automatically positionable into receiving relation with the shell molds to be ejected and removed from the mold box assembly.

It is important to note that an equilibrium condition will be reached on the interior of the mold box assembly of the present invention between the introduced catalyst gas (introduced at a greater than atmospheric pressure) and the air within the volume of the mold box assembly due to the principle of Pascal's Law and Boyle's Law. Specifically Pascal's Law states that pressure applied to enclosed fluid at rest is transmitted undiminshed to every portion of the fluid and the walls of a containing vessel. Boyle's Law states that the pressure times volume is a constant for a constant mass of gas at a constant temperature. The present invention is directed to an application of Pascal's Law and Boyle's Law in order to develop, a process with a heatless production of a shell mold wherein the dimensions of such mold are determinable and predictable.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
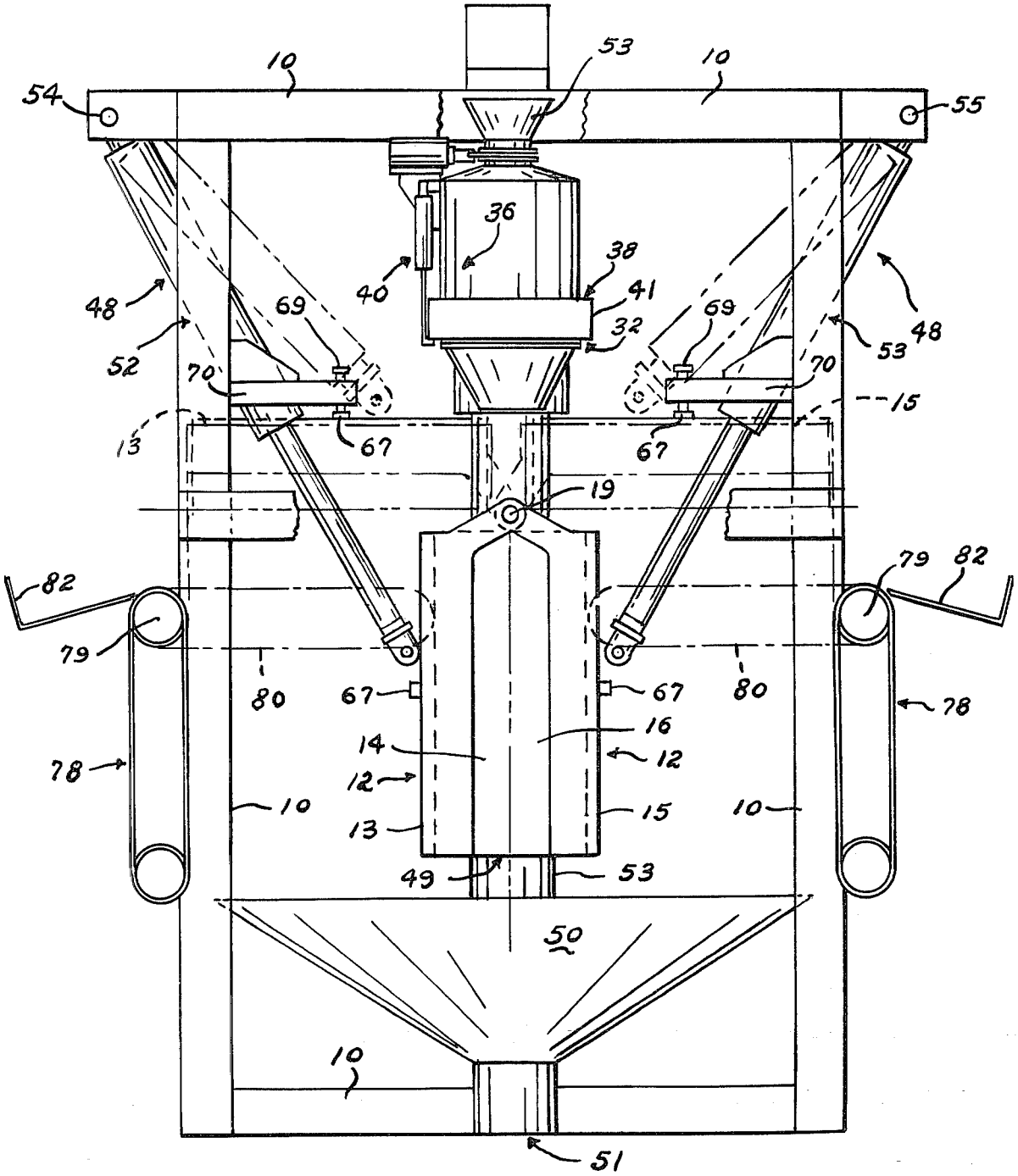
FIG. 1 is a front view of the supporting frame and mold box assembly of the present invention in its closed position wherein broken lines indicate mold box sections in their open separated position.

As best shown in FIG. 1 the subject invention relates to an assembly for the production of foundry shell molds comprising a frame 10 disposed in supporting relation to a mold box assembly generally indicated as 12.

Figure 2:
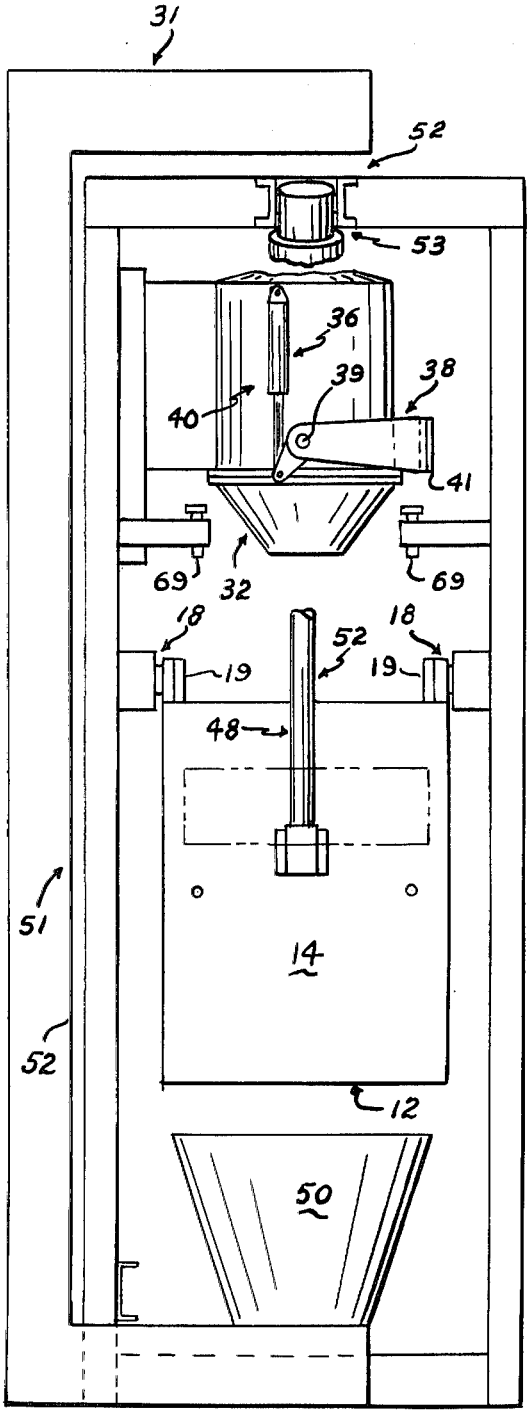
FIG. 2 is a side view in partial cutaway of the embodiment of FIG. 1.
Figure 3:
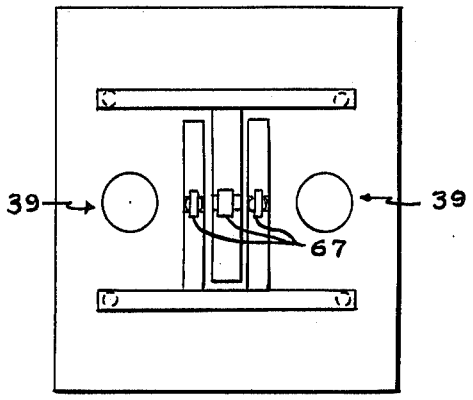
FIG. 3 is a side view of the mold box assembly of the embodiment of FIG. 4 showing linkage system and ejection mechanism.

The mold box assembly 12 comprises two mold box sections 14 and 16 attached to support plates 13 and 15 which are pivotally mounted as at 18 to the supporting frame 10 so as to rotatably or pivotally move about the pivot axis 19 disposed in the embodiment of FIGS. 1 and 2 in a substantially horizontal plane. With reference to FIGS. 3, 4, 5 and 6 it is seen that the box sections 14 and 16 are disposed in their closed position in a substantially vertical orientation and separated by an imaginary vertical plane 20 defined by the engagement of the correspondingly disposed periphery of each box section 14 and 16. The sealing engagement between the box sections 14 and 16 as accomplished, will be described in greater detail hereinafter.

Figure 4:
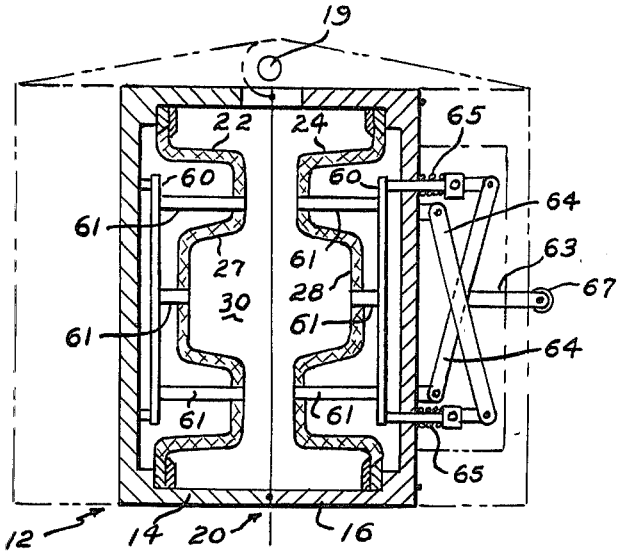
FIG. 4 is a sectional view of the mold box assembly immediately prior to charging with the binder coated sand or granular material with details of the ejection assembly of the present invention.
Figure 5:
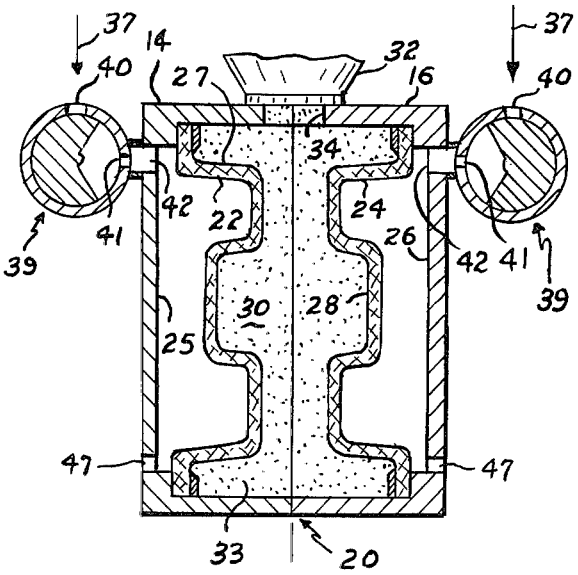
FIG. 5 is the interior of the mold box assembly in partial section showing the box and pattern sections with the charged granular mass in the interior portion between the pattern sections.
Figure 6:
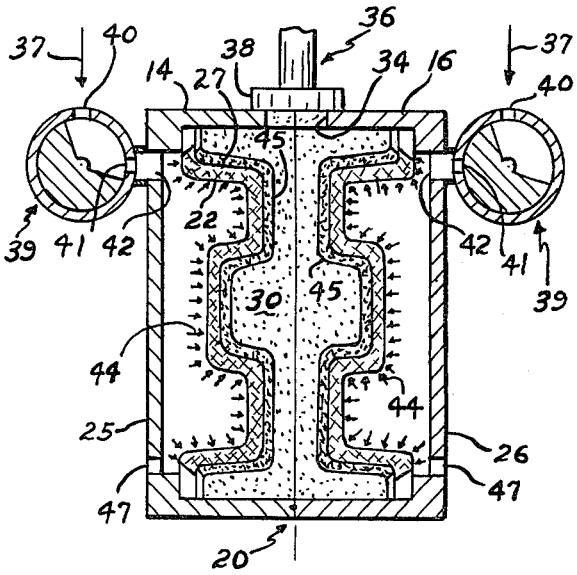
FIG. 6 is the structural embodiment of FIGS. 4 and 5 with the catalyst gas being exposed to the charged mass of granular material causing formation of the shell mold or core as shown.

Pattern means for drag and cope parts of the mold comprising pattern sections 22 and 24 are mounted within each box section 14 and 16 respectively so as to be disposed in spaced relation from a base portion 25 and 26 (FIG. 5 and 6) respectively of the box sections 14 and 16. The pattern sections 22 and 24 define drag and cope parts of the mold and have a predetermined configuration intended to correspond to the resulting configuration of the drag or cope. Pattern sections are so disposed in facing engagement to one another, the separating plane 20 and an interior portion 30 defined between the pattern sections 22 and 24 when the mold box sections 14 and 16 are in their closed position as shown in FIGS. 4, 5 and 6.

With regard to the interior portion 30 a charge of binder coated sand or granular material is forced therein from investment means 32 for instance a conventional sand blower which also serves as a supply facility for maintenance of predetermined amounts of the sand or granular material therein. More specifically the investment means 32 is disposed in direct communication with investment hole or aperture 34 formed on the top of mold box 12 for the passage of the sand or granular mass 30 therethrough. A seal means generally indicated (FIG. 6) as 36 is positionable in sealing engagement with the investment aperture 34 so as to seal the interior of the box assembly 12 from atmosphere. This sealing prevents the catalyst gas from passing through the entire mass of sand 30 upon introduction of the catalyst gas into the mold box assembly.

The sealing member of facility 36 may be mounted on the exterior of the investment means 32 and comprises a pivotally mounted sealing arm 38 hingedly attached at 39 so as to pivot upon actuation of fluid cylinder assembly 40 into covering relation relative to the investment aperture 34. More specifically a sealing pad 41 made from a flexible or like sealable material may be secured to the bottom portion of the sealing arm 38 so as to fit over the sealing aperture 34 as schematically represented in FIG. 6. Accordingly, pressure, of a predetermined degree is capable of being maintained on the interior of the mold box assembly 12. Gas is thereby prevented from passing through sand 30 and aperture 34 into atmosphere.

As stated above formation of the shell mold or product is due to exposure of the binder coated sand or granular material 33 within the interior portion 30 with predetermined catalyst gas. With reference to FIGS. 5 and 6 a catalyst gas is introduced from a supply (not shown) generally represented by directional arrow 37. The catalyst gas passes into a valving facility 39 through conduit or entrance 40 for direct fluid communication with and passage into the interior of each box assembly 14 and 16.

With reference to FIG. 6 the valve assembly 39 is disposed to establish fluid communication between the supply 37 and the entrance aperture 41 through inlet 42. The investment of the catalyst gas occurs at a pressure greater than atmosphere while the mold box sections 14 and 16 are disposed in their closed and sealed relation to one another thereby effectively segregating the interior of the mold box assembly from atmosphere. It should be noted that each box section 14 and 16 is provided with a vent or exhaust means 47 disposed in spaced apart relation from inlet 42. This exhaust means 47 is maintained open some brief period of time immediately subsequent to introduction of the catalyst gas through inlets 42. This exhaust means 47 is left open only until the air within the box sections are flooded from the interiors thereof. The box sections 14 and 16 are then sealed as the exhaust means 47 is closed. Upon the introduction of the catalyst gas at a pressure greater than atmosphere through the pattern sections 22 and 24, a pressure is exerted against the enclosed air volume. The catalyst gas, due to its being introduced at a higher pressure will penetrate a distance through the sand or granular material 33 wherein such distance of penetration is determined by equilibrium being achieved between the applied catalyst gas pressure and a resisting pressure developed by enclosed air. As best shown in FIG. 6 and indicated by the plurality of pressure arrows 44 representing the penetrating catalyst gas, hardening or curing is effected and a shell mold 45 is produced with a thickness determined by the extent of the catalyst gas penetration.

After formation of the core or mold product 45 has been established, the valve facilities 39 are closed. Exhausts 47 through valving (not shown) are opened and sealing arm 38 is removed so as to establish communication between the interior of the mold box assembly 12 and each mold box section 14 and 16 with atmosphere or a gas removal or waste facility.

After formation of the shell mold product 45 and after evacuation of the catalyst gas as described, positioning means (FIGS. 1 and 2) generally as 48 serve to separate the box sections 14 and 16 away from the separating plane 20 and into a first and second open position as will be described in detail hereinafter. The opening or separating of the box section 14 and 16 causes the flow of the unused granular or sand material from the opposite portion of the mold box assembly generally indicated as 49 through the action of gravity. When in its open position, the mold box assembly (open position represented in broken lines of FIG. 1) allows the unused granular material to fall into a collection hopper 50 defining a portion of the transfer means (FIG. 2) 51. Such transfer means includes, in addition to the prepositioned hopper 50, a conveyor in the form of a mechanical delivery conveyor housed with conduit or casing 52 and extending between the collection hopper 50 and a point of delivery generally indicated as 53 into the interior of the supply or investment means 32. Accordingly, waste of material not used in the actual solidification or formation of the mold or core product 45 is eliminated through the recollection, transfer and resue of the unused granular or sand particles through the provision of the mechanical conveyor housed within casing or conduit 52 and defining a major portion of the transfer means 51. Generally mechanical conveying is preferred since the type of binder used does not tolerate the airation of a pneumatic conveyor system.

The positioning means, again to be described in greater detail hereinafter, is disposed to separate the box sections 14 and 16 from one another and outwardly from the vertically oriented separating plane 20. The open position is clearly defined by the broken line representation of box sections 14 and 16 in FIG. 1. The open position may be defined as a separated orientation or position of the box sections 14 and 16 from one another between their truly closed or sealed position as shown in solid lines in FIG. 1. More specifically the open position may be completed at generally a 90° separation or angular inclination from the separating plane 20. When the box sections are moving to their open position this angular inclination is such as to allow complete removal of the unused sand material into the hopper 50.

The positioning means 48 comprises oppositely disposed piston and cylinder assemblies 52 and 53 having their distal end pivotally attached to the supporting frame 10 as at 54 and 55 respectively. Both of the piston and cylinder assemblies 52 and 54 are fluid activated wherein at least one of the assemblies such as 53 has a predetermined greater fluid pressure than the oppositely disposed and cooperating assembly 52. In turn, the other of the assemblies 52 has a longer stroke because of the dimensional differences between the piston and cylinder assembly 52 with that of the piston and cylinder 53. These dimensional differences cooperate to effect a firm sealing engagement between the mold sections 14 and 16 specifically along the vertically oriented plane 20 as will be explained. Due to the fact that the assembly 53 as a greater fluid capacity it is activated to extend outwardly to its greatest distance stroke which will position the associated mounted box assembly 16 in the predetermined desired orientation relative to the intended closed position along the separating plane 20. Simultaneously the assembly 52 is activated and serves to rotate the associated box section 14 downwardly into firm engagement with the position of box section 16. Due to the greater force being exerted on box section 16 the forced engagement of box 14 with box 16 will not cause a displacement or movement of box 16 from its predetermined position.

The downward stroke of assembly 52 will continue until firm engagement of box 14 with box 16. Since box 16 will not move from its vertically oriented predetermined position, box 14 will accordingly be disposed in the desired sealed and closed mating position relative to box 16 and the vertical separating plane 20 since the downward stroke of the assembly 52 will occur until such mating engagement is accomplished.

With regard to ejection means primary reference is made to FIG. 4 as well as FIGS. 1 and 2. The ejection means comprises an ejection plate 60 mounted on the interior of each box section 14 and 16 and having ejection pins 61 extending outwardly therefrom into penetrating relation to the respective patterns 22 and 24 so as to pass therethrough (FIG. 4). Activation of the ejection means occurs through the movement of two pairs of rods 63 serving to pivot lever arms 64 against biasing springs 65 in a manner that will be readily apparent through thorough review of FIG. 4. The downward forcement of rods 63 occurs upon each of the sections 14 and 16 moving upwardly to their open position as shown in FIG. 1. By virtue of being disposed in such position the roller elements 67 come into interruptive engagement with support arms 70 which may be in the form of adjustable fingers 69. The specific disposition of the fingers 69 may again be adjusted relative to support arms 70 of the frame 10 so as to precisely control the ejection mechanism through interruptive engagement of the member 69 with the rollers 67. For purposes of clarity of FIG. 4 shows only a single ejection facility including rod 63 and roller 67 cooperating with the ejection facility mounted within box section 16. However, it should be noted that such an ejection facility cooperates with each of the box sections 14 and/or 16 to effectively remove the products 45 formed (FIG. 6). Removal of the product once formed occurs through automatic actuation of an product removal means generally indicated as 78 in the form of conveyors or like apparatus or support tables pivotable about axis point 79 into receiving position indicated in broken lines as 80. Such broken line positioning is representative of the position which the conveyor or receiving facility 78 are positioned to receive the products, once ejected. When the ejection means is properly activated the products 45 will fall or be forced from the working surface of the each pattern sections 22 and 24 and be delivered on the product removal means 78. Transfer, through proper activation of conveyor facilities to a supply or transfer table 82 is readily accomplished so as to dispose the various formed core or mold products 45 out of the path of travel of the remaining structural components of the assembly when it passes into its next operative cycle.

For purposes of clarity it should be noted that the preferred embodiment shows the arrangement of the mold box in a substantially vertical orientation wherein the box sections 14 and 16 are moved outwardly in separating relation from the vertically oriented separating plane 20. In such orientation the pivotal axis 19 is arranged in a substantially horizontal plane. However, it is within the concept of the present invention to reorient the entire mold box assembly so as to have it operate in a horizontally oriented plane such that the pivotal axis 19 about which the box sections 14 and 16 rotate is disposed in a substantially vertical plane while the separating plane is also maintained in a vertical plane.

Another embodiment of the present invention comprise the provision of the frame means including plates 13 and 15 having attached thereto conventional shell mold sections of the type used in the aforementioned Croning process. These mold box sections will utilize heat for curing the binder coated sand and the provision of heating facilities will be included in the same way as it is used currently with the Croning process. Such heating facilities and conventional type mold box sections are well known and accordingly not shown or discussed in detail herein.

In the primary embodiment of the present invention the pattern sections secured within the mold box assembly are, as set forth above, permeable and are specifically disposed, configured and structured so that one of such pattern sections defines the cope of the produced mold while the other of such pattern sections defines the drag of such mold. The placement of the cope and drag portions of the pattern sections, as set forth above, are positionable to form a common cavity on the interior thereof such that cope and drag portions of the resulting shell mold will be formed concurrently from the same mold box assembly rather than separately as is now done in the currently known or conventional process.

Yet another embodiment of the present invention comprises, as shown in FIGS. 5 and 6 the placement of the ventilation or exhaust portion or outlet 47 in spaced apart relation from the inlet aperture 42. This structure is important in part so as to allow flushing or instantaneous removal of the normal, atmospheric air within the space between the base 25 and the pattern section of each mold box assembly upon entering of the catalyst gas therein. More specifically the vent or exhaust means 47 are left open for a certain minute, predetermined length of time upon and immediately concurrent to the entrance of the catalyst gas into the chamber through inlet 42. Such vents are allowed to remain open, such predetermined minute period of time, until all of the normally atmospheric air or gas is flushed out of this section as the catalyst gas enters therein.

Another procedural step is possible due to the separated locations of the vent or exhaust means 47 and the inlet means 42. Such flushing of the air from this interior allows the catalyst gas to be undiluted as it reaches the binder coated sand within the common cavity between the cope and drag pattern sections of the mold.

Another step in the process of forming the shell molds of the present invention comprises, in another embodiment, the provision of continuous flow of gas between the inlet and the exhaust 47 wherein such flow of catalyst gas is thereby directed along the pattern section. This continuous flow allows molecular diffusion between the gas and the air inside of the sand mass and allows action of the binder cuasing hardening of the layer of binder coated sand immediately contiguous the working surface of each pattern section.

In addition a step of the subject process includes maintaining the sand mixture in exposed relation to the catalyst gas for a predetermined extended period of time. This extended exposure significantly adds to the tensil strength of the ultimately formed shell mold product. This additional strength is necessary so that the formed product can withstand the forces of ejection and handling after the molds leave the pattern. Such extended period of time is sufficient in the range between 25 and 30 seconds. Since the general thickness of the resulting shell mold is significantly less than normal resulting products using conventional processes and apparatus, the above set forth additional tensil strength is required for the ejection and handling steps to follow formation of the formed product.

Figure 7:
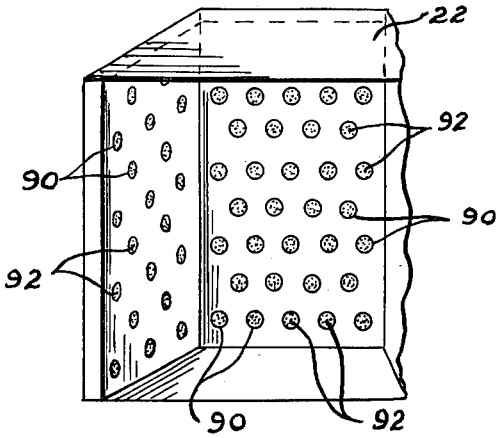
FIG. 7 is a perspective view of one embodiment of the pattern portion of the present invention.
Figure 8:
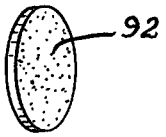
FIG. 8 is a perspective view of a porous metal insert used in the pattern embodiment of FIG. 7.

Finally with regard to FIGS. 7 and 8, one embodiment of the present invention comprises the formation of the pattern represented herein as at least one of the pattern sections 22′ from the plurality of porous metal elements 92 disposed within similarly configured apertures 90 formed in the pattern section 22′. The individual porous metal elements 92 may be formed from a bronze centered powder metal material having a pore size of between 5 to 25 microns. In addition, each of the inserts or elements are disposed in spaced apart relation to one another a predetermined distance at least equal to twice the diameter of the elements themselves. Such spaced apart array or pattern is defined by the inserts and apertures 90 in which they are placed being disposed in an alternate, substantially offset relation to one another as shown in FIG. 7. This allows substantially even and consistent exposure of the catalyst gas as it passes through the porous metal inserts to the binder coated sand disposed contiguous to the working surface of the pattern section.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described,

What is claimed is:

1. An assembly of the type used for the production of foundry shell molds composed from a granular material, said assembly comprising: frame means structured and disposed into substantially supporting relation to a remaining portion of said assembly; catalyst gas supply means in fluid communication with a mold box assembly mounted on said frame means and disposable between an open and closed position, said mold box assembly comprising at least two separate non-permeable box sections at least one of which is pivotally attached to said frame and movable in a single plane into and out of sealing engagement with the other; gas permeable pattern means having a predetermined configuration mounted within said mold box assembly and including at least one pattern section mounted within said at least one pivotally attached box section, said pattern section disposed in spaced apart relation from said other box section to form a cavity on an interior portion of said pattern means and being disposed in spaced apart relation from a base portion of said pivotally attached box section, the boundry of said cavity being at least partially defined by a working surface of said pivotally attached box section when said mold box assembly is in its closed position; investment means including an outlet having its axis disposed in said single plane of movement and further disposed in direct communication relative to said cavity, whereby granular material is disposable within said cavity through said investment means so as to be disposable in direct contiguous relation with said interior portion of said pattern section.

2. An assembly as in claim 1 wherein said at least one pivotally attached box section comprises a solid non-permeable wall section structured and configured to define an enclosure about said at least one pattern section positioned on the interior thereof, each pattern section formed from a gas permeable material whereby fluid flow communication is established between said interior portion and granular material therein and the remainder of the interior of said pivotally attached mold box.

3. An assembly as in claim 1 further comprising fluid inlet means connected to said mold box assembly and disposed in communicating relation to the interior of both said box sections, valve means connected in fluid communicating relation to said fluid inlet means and further disposed in flow regulating relation between said fluid inlet means and fluid supply means, whereby gas fluid passing into said box section through said inlet means may flow through said pattern section correspondingly positioned and into said interior portion into contact with the granular material therein.

4. An assembly as in claim 8 wherein said closed position of said mold box assembly is defined by mating and sealing engagement of the outer peripheral edge portion of each box section with one another, each of said box sections so disposed to define said combined sealing engagement along a substantially vertical oriented separating plane, said pattern section comprising a working surface and disposed with said pivotally attached box section such that said working surface of said pattern section is positioned in exposed relation to said separating plane, said interior portion and said other box section.

5. An assembly as in claim 4 wherein at least said pivotally attached box section is partially connected to said frame means and pivotally movable relative thereto between said closed and open positions about a pivotal axis, said pivotal axis and the axis of said investment means outlet disposed substantially within said vertically oriented separating plane.

6. An assembly as in claim 5 wherein said pivotal axis is substantially horizontally oriented, said pivotally attached box section movable away from said other box section in a substantially arcuate vertical path of travel into said open position.

7. An assembly as in claim 5 wherein said pivotal axis is substantially vertically oriented, said pivotally attached box section movable away from said other box section in a substantially arcuate horizontal path of travel into said open position.

8. An assembly as in claim 1 further comprising ejection means disposed at least in part on the interior of said mold box assembly between said pattern section and said base portion of said pivotally attached box section, said ejecting means including activating means extending outwardly from said mold box assembly into interruptive engagement with at least a portion of said frame means when said mold box assembly is disposed in its open position, whereby engagement therebetween forces movement of said activating means and activation of said ejection means into product ejecting position.

9. An assembly as in claim 8 wherein said ejecting means comprises at least one base plate movably mounted on the interior of said pivotally attached box section between said base portion and pattern section associated therewith, a plurality of ejecting pins mounted on said base plate and extending outwardly therefrom into movable engagement with said pattern section, a linkage assembly including a lever arm means movably interconnected between said base plate and said activating means and disposed to force movement of said base plate towards said pattern section upon interruptive engagement of said activating means with said frame means, said ejecting pins being so disposed to pass through said respective pattern section and into engagement with the product being formed contiguous a working surface of said pattern section, whereby said product is forced from said mold box assembly.

10. An assembly as in claim 8 wherein said activating means comprises roller head means, said linkage assembly structured and disposed to activate all ejection pins in a straight line motion upon interruptive engagement of said roller head means with said frame and straight line movement depression of the former.

11. An assembly as in claim 5 wherein said open position is at least partially defined by an outward positioning of said pivotally attached box section relative to said vertically oriented separating plane, said outward disposition of said box section positioned a predetermined angle from said vertical separating plane defining a discharge position of said mold box assembly, whereby loose granular material is emptied from said interior portion after formation of the mold product while maintaining the investment means aperture axis in an unchangeable position.

12. An assembly as in claim 11 wherein said investment means comprises aperture means formed in said mold box assembly in direct communication with said interior portion, said discharge position structured independently from said investment means whereby investment into and removal of loose granular material from said interior portion is accomplished at spaced apart positions and portions of said mold box assembly.

13. An assembly as in claim 1 further comprising granular material supply means disposable adjacent said investment means and in communicating relation to said interior portion and operable to transfer granular material therein, closure means movably interconnected to said frame means and disposable into substantially sealing engagement with said investment means and in segregating relation between said interior portion and atmosphere.

14. An assembly as in claim 1 further comprising material transfer means disposed in receiving relation to the interior of said pattern means, whereby loose granular material from said mold assembly is received by said transfer means when the material is discharged therefrom.

15. An assembly as in claim 14 wherein said material transfer means comprises a mechanical, non-pneumatic conveyor assembly disposed in material transfer relation between substantially the area of discharge of the granular material and said granular material supply means, whereby unused granular material from said interior portion is returned to said material supply for reuse.

16. An assembly as in claim 1 further comprising a mold box assembly structured for use in heated conditions, heating means disposable in exposed position relative to said mold box assembly and in heat conducting relation thereto.

17. An assembly as in claim 1 wherein said pattern section is formed at least in part from a plurality of porous metal elements disposed in spaced apart location from one another a predetermined distance, said spacing defining a predetermined pattern configured for optimum exposure of catalyst gas passing through said plurality of porous metal elements to the binder coated granular material positioned contiguous said interior portion of said pattern section.

18. An assembly as in claim 17 wherein the distance between any two of said plurality of elements equals substantially twice the diameter of one of said elements, said predetermined pattern substantially comprising offset substantially stagered spaced apart disposition of said elements.

19. An assembly as in claim 8 wherein said other box section is pivotally attached to said frame for movement in said single plane and includes a pattern section mounted therein, further comprising means for concurrently moving each pattern section and respective mold box section away from the vertically oriented separating plane to a substantially horizontal attitude defining an open position of the mold box and pattern sections and allowing the unhardened granular material to be removed from the common cavity between the pattern sections.

20. An assembly as in claim 19 further comprising means for moving an ejection assembly attached to each mold box section into interruptive engagement with a supporting frame portion for said mold box section when said mold box sections are moved to their respective horizontal attitudes whereby a formed product is ejected from each pattern section.

21. An assembly as in claim 19 further comprising positioning means including a first and second fluid activated cylinder and piston assembly, each secured in interconnecting moving relation between said frame means and one of said box sections; said first cylinder and piston assembly comprising a predetermined fluid pressure greater than that of said second cylinder and piston assembly, said second cylinder and piston assembly having an effective working stroke of said piston longer than that of said first cylinder and piston assembly whereby the extended stroke of said first cylinder and piston assembly disposes one of said box sections into its closed position and the extended stroke of said second cylinder and piston assembly disposes the other of said box sections into sealing engagement with said box sections associated with said first cylinder and piston assembly.

22. An assembly as in claim 21 wherein each of said first and second cylinder and piston assemblies are disposed and dimensioned to define said closed position of said mold box assembly along said vertically oriented separating plane.

* * * * *